US005598877A

United States Patent [19]

Reidel

[11] Patent Number: 5,598,877

[45] Date of Patent: Feb. 4, 1997

[54] REUSABLE LIQUID DISPENSER

[76] Inventor: Hermann Reidel, Brunnenstrasse 3a, D - 63791 Karlstein, Germany

[21] Appl. No.: 326,591

[22] Filed: Oct. 20, 1994

[51] Int. Cl.[6] ..... B65B 1/04

[52] U.S. Cl. ..... 141/346; 141/384; 222/162

[58] Field of Search ..... 141/384, 383, 141/366, 351, 352, 353, 346; 222/162, 325, 501, 507–509, 519–522

[56] References Cited

U.S. PATENT DOCUMENTS

| | | | |
|---|---|---|---|
| 3,058,631 | 10/1962 | De La Hitte | 222/507 |
| 3,082,286 | 3/1963 | Schuster | 141/366 X |
| 4,311,174 | 1/1982 | Walsh, III | 141/383 |
| 4,372,467 | 2/1983 | Pritchitt | 222/501 |
| 4,380,310 | 4/1983 | Schneiter et al. | 222/501 |
| 4,391,308 | 7/1983 | Steiner | 141/18 |
| 4,972,976 | 11/1990 | Romero | 141/353 X |
| 5,273,083 | 12/1993 | Burrows | 141/346 X |
| 5,379,813 | 1/1995 | Ing | 141/353 X |
| 5,402,836 | 4/1995 | Hasper et al. | 141/346 X |
| 5,477,895 | 12/1995 | Willard | 141/346 X |

FOREIGN PATENT DOCUMENTS

| | | |
|---|---|---|
| 0114026 | 7/1984 | European Pat. Off. . |
| 2184086 | 12/1973 | France . |
| 7217720 | 9/1972 | Germany . |

*Primary Examiner*—Kevin P. Shaver

*Attorney, Agent, or Firm*—Webb Ziesenheim Bruening Logsdon Orkin & Hanson P.C.

[57] ABSTRACT

A liquid dispenser having a batcher with a holder. The holder has an internal thread. An opening pin is centrally arranged within the holder and also has a thread. A reservoir is provided which has a connecting neck screwable into the internal thread of the holder. An internal closure is displaceably arranged within the connecting neck of the reservoir. The internal closure is configured as a sleeve and is provided with a thread screwable onto the opening pin of the holder.

6 Claims, 2 Drawing Sheets

REUSABLE LIQUID DISPENSER

FIELD OF THE INVENTION

The present invention is concerned with a liquid dispenser for dispensing liquid from a reservoir into a batcher from which the liquid can then be discharged in batches. The liquid dispenser is intended, in particular, for liquid soap; however, it can also be used for other liquids of an identical or similar consistency.

DESCRIPTION OF THE PRIOR ART

Liquid dispensers are known in the art, for example, from German Utility Model No. 7,217,720. As regards the liquid outlet channel and the internal closure, the latter is of such a design that the diameter of the closure body below the closure head is reduced and radial ribs are provided on the said part to define, on the closure body, axially aligned outlet channels. The channels, in the opening position of the internal closure also form cleared in-flow openings for the liquid out of the reservoir. Despite the faultless operation of reservoirs of this type provided with such a closure, it is desirable to improve the same as regards the re-useability of such vessels which, as a rule, are made of plastic material and which, according to the information available, hitherto have been simply thrown away after emptying. This also applies to a liquid dispenser or supply vessel of the type as disclosed by European Patent 0,114,026 which is also provided with an internal closure which, however, has to be fully forced into the vessel to then float as a quasi lost cork within the load of the vessel. In the liquid dispenser according to Utility Model No. 7,217,720 the inner closure remains seated in the opening position within the bottle neck. However, it cannot be readily removed, i.e. reservoirs of this type intended for use with liquid dispensers are not suitable for rapid industrial scavenging and reloading and it is equally difficult to restore the internal closure to the closing position.

SUMMARY OF THE INVENTION

It is an object of the invention to provide a liquid dispenser the supply vessel of which, despite the use of an internal closure, is capable to be cleansed and re-used.

A liquid dispenser according to the invention includes a batcher having a holder, with the holder having an internal thread and an opening position. An opening pin is centrally arranged within the holder and has a thread. A reservoir is provided having an outlet side and a connecting neck screwable into the internal thread of the holder. An interal closure is displaceably located in the connecting neck of the reservoir and has a bottom. At least one opening is provided below the bottom of the internal closure and is cleared in the opening position of the internal closure. A liquid outlet passageway is provided within the holder. The internal closure is designed in the form of a sleeve open toward the outlet side of the reservoir. The internal closure is provided with a thread screwable onto the opening pin of the holder, with the thread of the internal closure having a pitch aligned with the thread of the connecting neck of the reservoir. The pitch of the threads of the internal closure and the thread of the opening pin is lower than the pitch of the threads of the connecting neck and the internal thread of the holder.

The afore-described design of the liquid dispenser according to the present invention, admittedly, requires that a mandrel provided with a corresponding thread be arranged on the holder of the batcher for the connecting neck of the reservoir. However, conversely, the design according to the invention involves the advantage that—compared to the other-way-round on-screwing process—also the internal closure automatically recloses when turning the connecting neck out of the holder of the dispenser. In largely emptied reservoirs stored intermediately for re-using purposes, this will involve the advantage that the interior of the reservoir in which always a certain amount of residual liquid will be left, will not be exposed to bacterial infestation or other contamination. Moreover, the internal closure for scavenging and reloading purposes can be readily drawn out with the aid of a simple auxiliary tool which once provided with a corresponding thread is only to be screwed one or two leads into the externally open sleeve in order to enable the internal closure to be entirely drawn out.

In a preferred form of embodiment of the liquid dispenser according to the present invention, the opening pin of the holder is configured as a sleeve which is provided with an internal thread, with the thread of the internal closure being an external thread corresponding to the internal thread of the sleeve. For, the afore-mentioned cork-type internal closure in the basic solution contains an internal thread. However, the manufacture of internal threads of this type requires relatively expensive forming dies for injection moulding in order to enable the item concerned to be moulded. As the inner closure having this type of internal thread is a mass-produced item, it has proved to be substantially more advantageous to provide the internal closure with an external thread and to provide the holder with a sleeve of a diameter smaller than the internal thread thereof and disposed at a space and having an internal thread conforming to the outer thread of the internal closure.

The effect of the automatic opening and closing of the internal closure, admittedly, is the same as in the basic design according to the present invention. However, the simple arrangement of an external thread on the internal closure involves the advantage that this part can be produced as a mass article with the aid of substantially simpler forming dies and can be more easily moulded therefrom in the same way as the external thread on the connecting neck of the reservoir. The provision of two internal threads on the holder of the liquid dispenser and batcher, respectively, is, admittedly, inevitable. However, conversely, the number of liquid batchers required is relatively low and the cost involved is more acceptable in respect of the batcher than in respect of the internal closure which should be a low-cost mass-produced article.

Advantageous embodiments of the preferred form of embodiment are manifested by the following features:

The threads between the connecting neck and the holder exhibit a pitch which is subtantially two to three times higher than the threads on the sleeve and on the inner closure.

Moreover, the upper edge of the sleeve is arranged one lead deeper than the upper edge of the holder and, virtually, centrally arranged within the sleeve is an aligning pin having a radial or cross-shaped cross-section and being of a conical configuration at the upper end and being slightly smaller than the cross-section of the liquid outlet channel within the internal closure, with the aligning pin protruding beyond the upper edge of the holder.

Preferred embodiments of the invention will hereinafter be described in conjunction with the accompanying drawings.

DESCRIPTION OF PREFERRED EMBODIMENTS

Figure 1A:
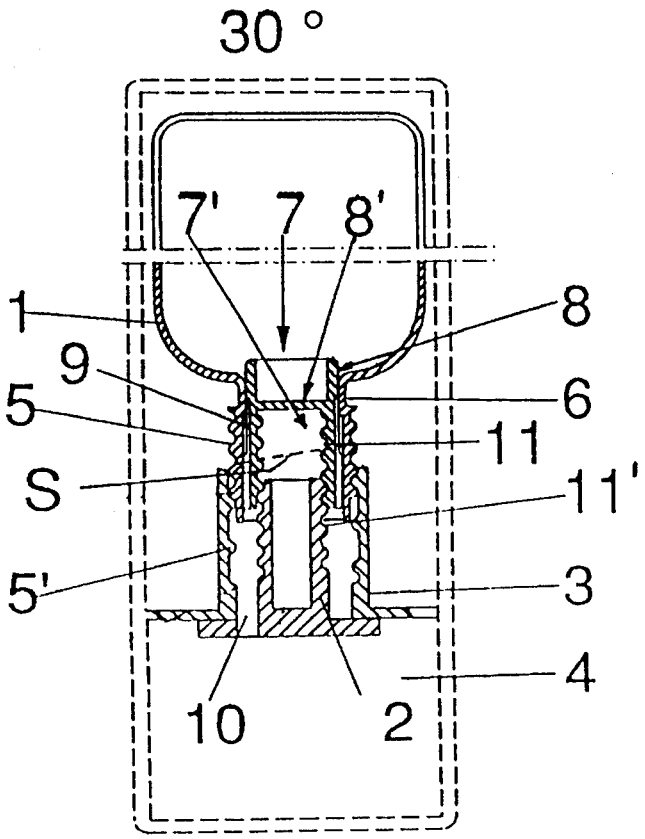
FIGS. 1A–1C are sectional views of the parts of the liquid dispenser presently of interest in various positions in accordance with the present invention.

The liquid dispenser of the present invention includes a batcher 4 having a holder 3 and an opening pin 2 centrally arranged within the holder. The holder is provided with an internal thread 5'. A reservoir 1 is provided with an outer thread 5 and a connecting neck 6 screwable into the internal thread 5' of the holder. An internal closure 7 is arranged within the connecting neck 6 of the reservoir 1, with the internal closure 7 being displaceably disposed within the connecting neck 6 of the reservoir 1. At least one opening 9 is provided below the bottom 8' of the internal closure 7 and is cleared in the opening position of the interal closure. A liquid outlet channel 10 is located within the holder. The batcher 4 is shown in broken lines as only holder 3 thereof is of interest for the accommodation of the connecting neck 6 of the reservoir, of which only the part presently of interest is shown along with the connecting neck 6. As conveyed by FIGS. 1 and 2, the reservoir 1 with the connecting neck thereof, basically, is inserted into the holder 3 in an overhead position.

It is important for a liquid dispenser of this type, in the practice of the invention, that the internal closure 7 is designed as a sleeve 7' open toward the outlet side of the reservoir 1, that the sleeve 7' is provided with a thread 11 screwable onto the opening pin 2 of the holder 3, that the thread 11 of the sleeve 7' has a pitch S in alignment with the thread 5 of the connecting neck 6 of the reservoir 1, that the pitch S of the threads 11,11' of the sleeve 7' and of the opening pin 2 is lower than the pitch S of the threads 5,5' of the connecting neck 6 and of the appertaining holder 3.

Figure 1B:
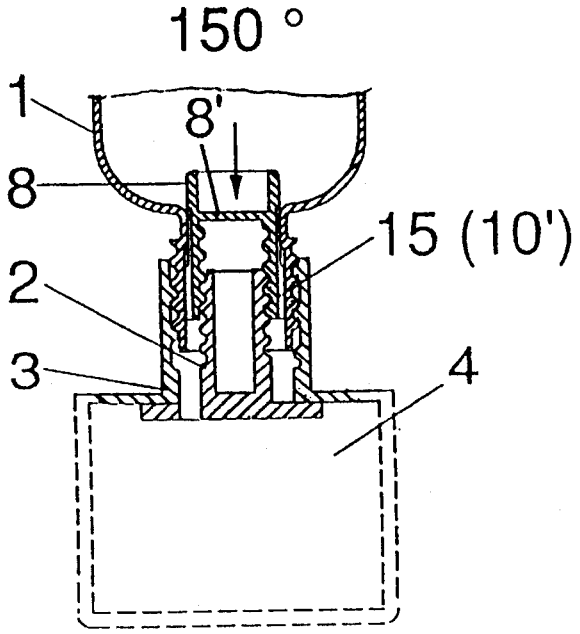
Figure 1C:
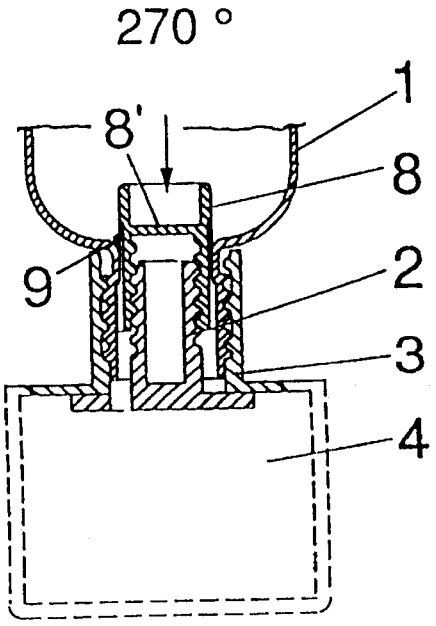

When screwing the connecting neck 6 into the thread 5' of the holder 3, sleeve 7' of the internal closure 7 will also get into engagement with the thread 11' of the opening pin 2 automatically screwing itself on, starting from the closing position according to FIG. 1A via the intermediate position according to FIG. 1B into the opening position according to FIG. 1C. When unscrewing the connecting neck 2, the same process takes place the other way round, i.e. in that case, the closing position according to FIG. 1A is reached again. In order to enable the internal closure 7 to be removed for scavenging and reloading purposes, it will only be necessary to screw an auxiliary tool of a design corresponding to the opening pin 2 one or two leads into the sleeve 7' to thereby enable the internal closure 7 to be completely drawn out. To prevent the internal closure 7, during screwing, from turning relative to the bottle neck 6, a torsion lock can be provided at a suitable point which has not been separately shown and need not be expressly explained. However, the provision of a torsion lock of this type is not imperative because the closure head 8 is seated adequately tightly within the connecting neck 6.

Figure 2A:
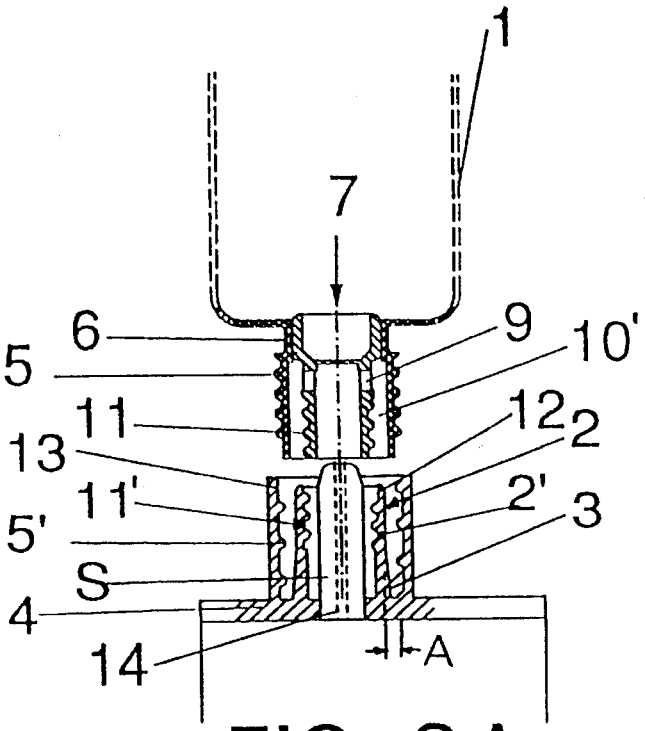
FIGS. 2A,B are corresponding sectional views in opening and closing positions of the preferred form of embodiment according to the present invention.

The preferred form of embodiment of the liquid dispenser according to the present invention is shown in FIGS. 2A, B and 3 which is substantially distinguished from the afore-described embodiment in that the thread 11' of a sleeve 2' of the holder 3 is an internal thread and the thread 11 of the internal closure 7 is a corresponding external thread. The threads 5,5' also have a pitch which compared to threads 11,11' is essentially two to three times greater. Moreover, the upper edge 12 of sleeve 2' is arranged one lead deeper than the upper edge 13 of the holder 3. The distance A between sleeve 2' and holder 3 must be so dimensioned as to cause the connecting neck 6 of the reservoir 1 to fit, with play, between sleeve 2' and holder 3.

Figure 2B:
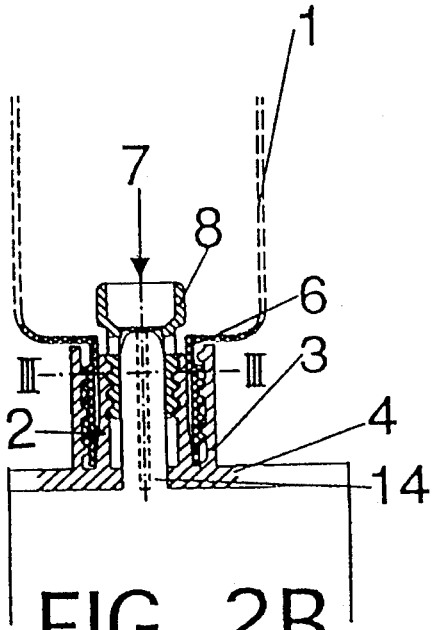
Figure 3:
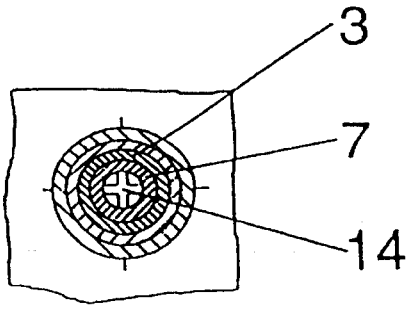
FIG. 3 is a cross-sectional view along line III—III in FIG. 2B.

Moreover, as conveyed by FIGS. 2 and 3, centrally arranged within the sleeve 2' is an aligning pin having a radial or cross-shaped cross-section and being of a conical configuration at the upper end thereof and being slightly smaller than the cross-section of the liquid outlet channel 10' within the internal closure 7. The pin 14 protrudes beyond the upper edge 13 of the holder 3. As the internal closure 7 only with the closure head 8 thereof is seated within the connecting neck 6 without always safeguarding the precisely coaxial seat relative to the connecting neck 6, the aligning pin 14 with the conical end thereof during in-screwing or even during mounting of the connecting neck 6 insures an axial alignment of the internal closure 7 and, hence, an operative engagement of the external thread 11 with the internal thread 11 of the sleeve 2'. The radial or cross-shaped cross-sectional configuration of the aligning pin 14 is required to provide outlet passageways for the liquid which, in the opening position (FIG. 2B) passes from the reservoir 1 through the cleared openings 9 into the passageways.

In the embodiment according to FIGS. 1A–1C there is no need to provide an aligning pin of this type as the internal closure is centrally guided, through axial ribs 15, over a relatively large distance, with the outlet passageways 10' in that embodiment being provided between the ribs 15.

The angular details in FIGS. 1A–1C refer to the degree by which the reservoir 1 must be respectively turned to reach the respectively shown position of the internal closure 7.

At 30° the reservoir 1 is still closed; at 150° the reservoir just starts to open and at 270° the reservoir is open.

While a full and complete description of the preferred form of embodiments of the invention has been set forth in accordance with the dictates of the Patent Statutes, it should be understood that modifications can be made thereto without departing from the spirit of the invention or the scope of the appended claims.

What I claim is:

1. A liquid dispenser comprising:

a batcher having a holder, with the holder having an internal thread and an opening position;

an opening pin centrally arranged within the holder and having a thread;

a reservoir having an outlet side and provided with a connecting neck having a thread and screwable into the internal thread of the holder;

an internal closure displaceably arranged within the connecting neck of the reservoir and having a bottom;

at least one opening located below the bottom of the internal closure and cleared in the opening position of the internal closure; and a liquid outlet passageway disposed within the holder, wherein the internal closure is configured as a sleeve open toward the outlet side of the reservoir, with the internal closure provided with a thread screwable onto the opening pin of the holder, with the thread of the internal closure having a pitch aligned with the thread of the connecting neck of the reservoir, and wherein the pitch of the thread of the internal closure and the thread of the opening pin is lower than the pitch of the thread of the connecting neck and the internal thread of the holder.

2. The liquid dispenser according to claim 1, wherein the opening pin of the holder is configured as a sleeve and the sleeve of the opening pin is provided with internal threads and wherein the thread of the internal closure is an external thread configured to engage the internal threads of the sleeve of the opening pin.

3. The liquid dispenser according to claim 2, wherein the thread of the connecting neck and the internal thread of the holder have a pitch which is at least two times greater than the pitch of the threads of the sleeve of the opening pin and the inner closure.

4. The liquid dispenser according to claim 2, wherein an upper edge of the sleeve of the opening pin is arranged one lead deeper than an upper edge of the holder.

5. The liquid dispenser according to claim 2, wherein the internal closure includes a liquid outlet channel and wherein a guiding pin is centrally arranged within the sleeve of the opening pin and protrudes beyond an upper edge of the holder, a diameter of the guiding pin is smaller than a diameter of the liquid outlet channel of the internal closure, and a cross-section of the guiding pin has a radial configuration.

6. The liquid dispenser according to claim 5, wherein the guiding pin has an upper end with a conical configuration.

* * * * *